US010794178B2

(12) United States Patent
Hempel et al.

(10) Patent No.: US 10,794,178 B2
(45) Date of Patent: Oct. 6, 2020

(54) ASSEMBLIES FOR COMMUNICATING A STATUS OF A PORTION OF A DOWNHOLE ASSEMBLY AND RELATED SYSTEMS AND METHODS

(71) Applicant: Baker Hughes, a GE company, LLC, Houston, TX (US)

(72) Inventors: Markus Hempel, Hannover (DE); Michell Schimanski, Edemissen (DE); Bryan C. Dugas, Breaux Bridge, LA (US)

(73) Assignee: Baker Hughes, a GE company, LLC, Houston, TX (US)

( * ) Notice: Subject to any disclaimer, the term of this patent is extended or adjusted under 35 U.S.C. 154(b) by 314 days.

(21) Appl. No.: 15/829,303

(22) Filed: Dec. 1, 2017

(65) Prior Publication Data

US 2018/0156033 A1 Jun. 7, 2018

Related U.S. Application Data

(60) Provisional application No. 62/429,519, filed on Dec. 2, 2016.

(51) Int. Cl.

| | |
|---|---|
| ***E21B 47/18*** | (2012.01) |
| ***E21B 7/28*** | (2006.01) |
| ***E21B 10/32*** | (2006.01) |
| ***E21B 47/00*** | (2012.01) |
| ***E21B 49/00*** | (2006.01) |

(52) U.S. Cl.

CPC ..... *E21B 47/18* (2013.01); *E21B 7/28* (2013.01); *E21B 10/322* (2013.01); *E21B 47/00* (2013.01); *E21B 49/00* (2013.01)

(58) Field of Classification Search

CPC ..... E21B 47/00; E21B 47/01; E21B 47/18; E21B 10/32; E21B 10/322; E21B 7/28

See application file for complete search history.

(56) References Cited

U.S. PATENT DOCUMENTS

| | | | |
|---|---|---|---|
| 5,402,856 | A | 4/1995 | Warren et al. |
| 6,360,831 | B1 | 3/2002 | Akesson et al. |
| 7,900,717 | B2 | 3/2011 | Radford et al. |
| 8,459,375 | B2 | 6/2013 | Radford |
| 9,341,027 | B2 | 5/2016 | Radford et al. |

(Continued)

FOREIGN PATENT DOCUMENTS

WO 2016004954 A1 1/2016

OTHER PUBLICATIONS

International Search Report for International Application No. PCT/US2017/064249 dated Mar. 20, 2018, 4 pages.

(Continued)

*Primary Examiner* — David Carroll
(74) *Attorney, Agent, or Firm* — TraskBritt

(57) ABSTRACT

Downhole assemblies comprise at least one sensor configured to sense at least one parameter relating to a downhole condition. The downhole assembly further includes a communications assembly having at least one device for controlling a characteristic of fluid flow through the downhole assembly and a processor in communication with the at least one sensor. The processor is configured to selectively alter the characteristic of fluid flow through the downhole assembly with the at least one device in response to data received from the at least one sensor.

26 Claims, 3 Drawing Sheets

(56) References Cited

U.S. PATENT DOCUMENTS

| | | | | |
|---|---|---|---|---|
| 2004/0134687 | A1 | 7/2004 | Radford et al. | |
| 2006/0249307 | A1 | 11/2006 | Ritter et al. | |
| 2010/0282511 | A1 | 11/2010 | Maranuk et al. | |
| 2014/0060933 | A1* | 3/2014 | Rasheed | E21B 10/32 175/50 |

OTHER PUBLICATIONS

International Written Opinion for International Application No. PCT/US2017/064249 dated Mar. 20, 2018, 4 pages.

* cited by examiner

ASSEMBLIES FOR COMMUNICATING A STATUS OF A PORTION OF A DOWNHOLE ASSEMBLY AND RELATED SYSTEMS AND METHODS

CROSS-REFERENCE TO RELATED APPLICATION

This application claims the benefit under 35 U.S.C. § 119(e) of U.S. Provisional Patent Application Ser. No. 62/429,519, filed Dec. 2, 2016, the disclosure of which is hereby incorporated herein in its entirety by this reference.

TECHNICAL FIELD

The present disclosure relates generally to assemblies and systems for communicating one or more of a downhole condition or a status of at least a portion of a downhole assembly in a subterranean formation, as well as downhole and bottom-hole assemblies including such assemblies and systems, and related methods.

BACKGROUND

Wellbores are formed in subterranean formations for various purposes including, for example, the extraction of oil and gas from a subterranean formation and the extraction of geothermal heat from a subterranean formation. A wellbore may be formed in a subterranean formation using downhole assemblies that may include numerous components of a drill bit, such as, for example, an earth-boring rotary drill bit and a reamer or stabilizer, such as an expandable reamer or stabilizer.

The drill bit is coupled, either directly or indirectly, to an end of what is referred to in the art as a "drill string," which comprises a series of elongated tubular segments connected end-to-end that extends into the wellbore from the surface of the formation. Often various tools and components (often referred to in the art as "subs"), including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through an annular space between the outer surface of the drill string and the exposed surface of the formation within the wellbore.

A reamer may be utilized in conjunction with a drill bit as part of a BHA when drilling a wellbore in a subterranean formation. In such a configuration, the drill bit operates as a "pilot" bit to form a pilot bore in the subterranean formation. As the drill bit and BHA advance into the formation, the reamer follows the drill bit through the pilot bore and enlarges the diameter of, or "reams," the pilot bore. In some instances, a reamer may be deployed to enlarge a previously drilled pilot borehole, to ream a "rathole" at the bottom of the wellbore, or to regain a diameter of a previously reamed borehole that has partially collapsed.

Conventionally in drilling oil, gas, and geothermal wells, casing is installed and cemented to prevent the wellbore walls from caving into the subterranean borehole while providing requisite shoring for subsequent drilling operations to achieve greater depths. To increase the depth of a previously drilled borehole, new casing or liner is laid within and extended below the previous casing. While adding casing or liner allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter limit the production flow rate of oil and gas through the borehole, it is often desirable to enlarge a subterranean borehole to provide a larger borehole diameter beyond previously installed casing.

Expandable reamers may include reamer blades pivotably or hingedly affixed to a tubular body and actuated by way of a piston disposed therein as disclosed by U.S. Pat. No. 5,402,856 to Warren. In addition, U.S. Pat. No. 6,360,831 to Akesson et al. discloses a borehole opener comprising a body equipped with at least two hole opening arms having cutting features that may be moved from a position of rest in the body to an active position by exposure to pressure of the drilling fluid flowing through the body. The blades in these reamers are initially retracted to permit the tool to run through the borehole on a drill string and, once the tool has passed beyond the end of the casing, the blades are extended so the bore diameter may be increased below the casing.

Expandable reamers include activation features for moving the reamer blades thereof between a deactivated position and an expanded, activated position. The blades in these expandable reamers are initially retracted to permit the tool to be run through the borehole on a drill string. At a depth (e.g., once the reamer has passed beyond the end of the casing), the expandable reamer may be actuated (e.g., hydraulically actuated). Actuation of the expandable reamer will enable the blades of the expandable reamer to be extended so the bore diameter may be increased below the casing.

One hydraulic actuation methodology involves wire line retrieval of a plug through the interior of the drill string to enable differential hydraulic pressure to actuate a reamer. Upon completion of the reaming operation, the reamer may be deactivated by redeploying a dart. However, wire line actuation and deactivation are both expensive and time-consuming in that they require concurrent use of wire line assemblies.

Another hydraulic actuation methodology makes use of shear pins configured to shear at a specific differential pressure (or in a predetermined range of pressures). For example, ball drop mechanisms involve the dropping of a ball down through the drill string to a ball seat. Engagement of the ball with the seat causes an increase in differential pressure that, in turn, actuates the downhole tool. The tool may be deactivated by increasing the pressure beyond a predetermined threshold such that the ball and ball seat are released (e.g., via the breaking of shear pins). However, such shear pin and ball drop mechanisms are generally one-time or one-cycle mechanisms and do not typically allow for repeated actuation and deactivation of a downhole tool.

Other actuation mechanisms may utilize measurement-while-drilling (MWD) systems and/or other electronically controllable systems including, for example, computer controllable solenoid valves. Electronic actuation advantageously enables a wide range of actuation and deactivation instructions to be executed and may further enable two-way communication with the surface via conventional telemetry techniques. However, these actuation systems tend to be highly complex and expensive and can be severely limited by the reliability and accuracy of MWD, telemetry, and other electronically controllable systems deployed in the borehole.

In each of these applications, it is desirable to determine the positioning or status of the expandable reamer (e.g., the blades of the expandable reamer) and to communicate that positioning or status to an operator of the drill string (e.g., to a user at the surface opening of the subterranean formation or to a remote operator). Generally, the positioning of the blades of an expandable reamer may only be either inferred based on a measured reduction in pressure of fluid (e.g., drilling fluid or mud) traveling through the drill string or by an electrical system that has been integrated with the reamer to control and monitor the blades (e.g., in a reamer having a fully integrated electrical system). In applications where a change (e.g., drop) in pressure is used to infer the position of the blades, such a single pressure change may occur where fluid in the drill string begins to be supplied to nozzles for cooling the blades as the blades are extended. In other implementations, a single pressure change may occur where a fluid in the drill string is redirected (e.g., through a bypass valve).

BRIEF SUMMARY

In some embodiments, the present disclosure includes a downhole assembly comprising at least one sensor configured to sense at least one parameter relating to a downhole condition and a communications assembly. The communications assembly comprises at least one device for controlling a characteristic of fluid flow through the downhole assembly and a processor in communication with the at least one sensor. The processor is configured to generate at least one signal by selectively altering the characteristic of fluid flow through the downhole assembly with the at least one device in response to data received from the at least one sensor.

In some embodiments, the present disclosure includes a method for monitoring a downhole condition comprising positioning a downhole tool into a borehole in a subterranean formation, sensing a parameter relating to a downhole condition with a sensor of the downhole tool, determining if a preselected downhole condition is met in response to the sensed parameter with a processor, transmitting a signal in response to the determination that the preselected downhole condition is met, and continuing the signal as long as the preselected downhole condition is met.

In some embodiments, the present disclosure includes a system for monitoring a downhole condition. The system comprises a downhole tool configured to be positioned in a borehole in a subterranean formation, a sensor in the downhole tool for sensing a parameter indicative of a downhole condition, a processor for determining if a preselected downhole condition is met, and a communications assembly for continuing a signal as long as the preselected downhole condition is met.

In some embodiments, the present disclosure includes an expandable tool assembly for reaming a subterranean borehole. The expandable tool assembly comprises an expandable tool module comprising at least one blade configured to move between a retracted position and an extended position and at least one sensor configured to sense movement of the at least one blade between the retracted position and the extended position. The expandable tool assembly further includes a communications assembly comprising at least one device for controlling a characteristic of fluid flow through the expandable tool assembly and a processor in communication with the at least one sensor. The processor is configured to selectively alter the characteristic of fluid flow through the expandable tool assembly with the at least one device in response to data received from the at least one sensor.

In some embodiments, the present disclosure includes a bottom-hole assembly including a downhole tool and at least one sensor configured to sense at least one operational characteristic of the downhole tool. The bottom-hole assembly further includes a communications assembly having at least one device for controlling a rate of fluid flow through the bottom-hole assembly and a processor in communication with the at least one sensor. The processor is configured to selectively alter the rate of fluid flow through the bottom-hole assembly with the at least one device in response to data received from the at least one sensor.

In some embodiments, such operational characteristics may include the status or condition of a downhole component. In some embodiments, such operational characteristics may include information regarding the formation or borehole (e.g., a formation parameter or borehole parameter), such as, formation evaluation measurement (e.g., acoustic, resistivity, nuclear, nuclear magnetic resonance (NMR)), which may identify a specific condition in the formation that is beneficial to be communicated to the surface. In some embodiments, a borehole condition may be communicated to the surface, like a "kick," for example, hydrogen sulfide ($H_2S$) gas entering the borehole, an unstable borehole that leads to decreased borehole diameter, accumulation of cuttings in cutting beds in horizontal boreholes which may lead to a stuck pipe event, and changing mud properties, like mud weight, temperature, temperature differences, pressure, and/or pressure differences.

BRIEF DESCRIPTION OF THE DRAWINGS

While the disclosure concludes with claims particularly pointing out and distinctly claiming that which is regarded as embodiments of the disclosure, various features and advantages of the disclosure may be ascertained from the following detailed description, when read in conjunction with the accompanying drawings, in which:

DETAILED DESCRIPTION

The illustrations presented herein are, in some instances, not actual views of any particular reamer tool, bottom-hole assembly (BHA), expandable tool assembly, or feature thereof, but are merely idealized representations that are employed to describe the present disclosure. Additionally, elements common between figures may retain the same numerical designation.

Although embodiments of the present disclosure are depicted as being used and employed in a reamer, such as an expandable reamer, persons of ordinary skill in the art will understand that the embodiments of the present disclosure may be employed in any downhole tool, system, or assembly where relaying information regarding a downhole component may be desirable. For example, embodiments of the assemblies disclosed herein may be utilized with various downhole tools including actuation assemblies such as downhole tools for use in casing operations, downhole tools for use in directional drilling, stabilizer assemblies, other expandable tools, hydraulic disconnects, downhole valves, packers, bridge plugs, hydraulic setting tools, circulating subs, crossover tools, pressure firing heads, coring tools, downhole sampling tools, liner setting tools, whipstock setting tools, anchors, etc. By way of further example, embodiments of the assemblies disclosed herein may be utilized with various downhole tools including earth-boring rotary drill bits, roller cone bits, core bits, eccentric bits, bicenter bits, reamers, mills, hybrid bits, electric impulse disintegrating devices employing both fixed and rotatable cutting structures, Moineau-type "mud" motors, turbine motors, steering devices and other drilling bits and tools.

In some embodiments, the assemblies disclosed herein may be utilized with expandable reamers similar to those described in, for example, U.S. Pat. No. 9,341,027, entitled "Expandable Reamer Assemblies, Bottom Hole Assemblies, and Related Methods," issued May 17, 2016, U.S. Pat. No. 8,459,375, entitled "Tools for Use in Drilling or Enlarging Well Bores Having Expandable Structures and Methods of Making and Using Such Tools," issued Jun. 11, 2013, and U.S. Pat. No. 7,900,717, entitled "Expandable Reamers for Earth-Boring Applications," issued Mar. 8, 2011, the disclosure of each of which is incorporated herein in its entirety by this reference.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
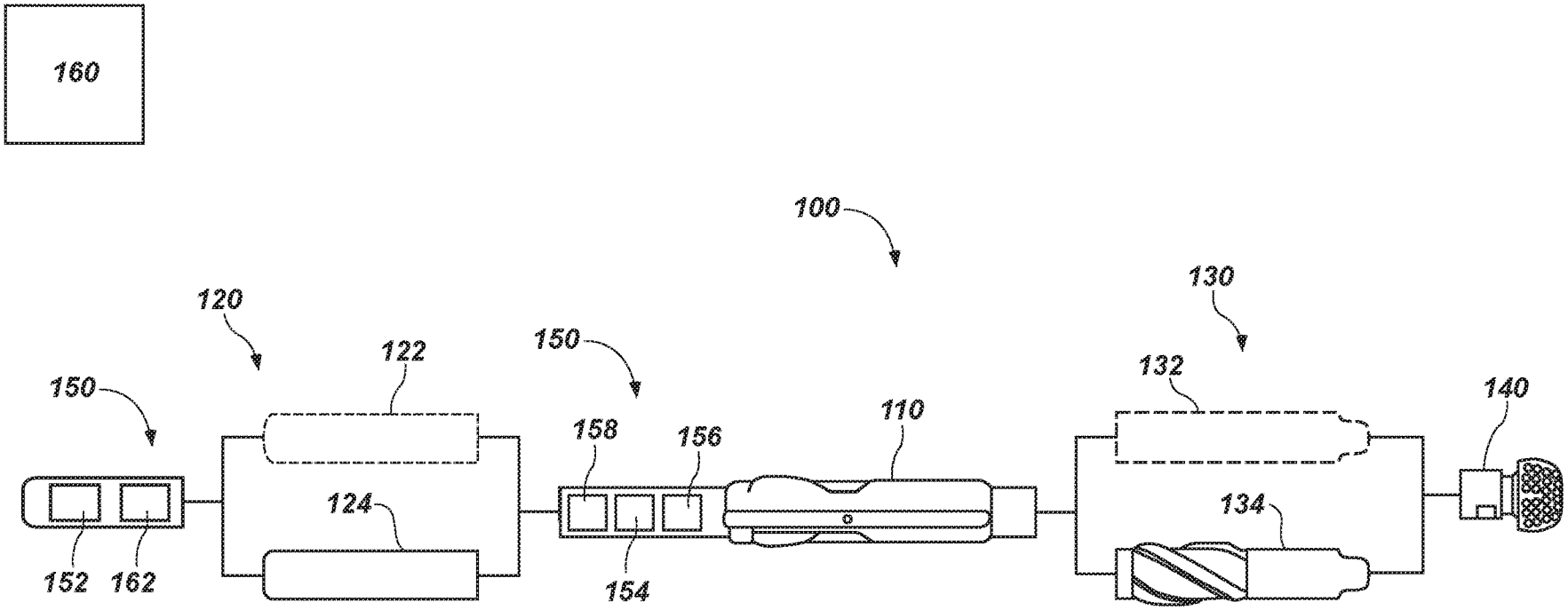
FIG. 1 is a schematic illustrating various implementations of a bottom-hole assembly (BHA) according to an embodiment of the present disclosure.

Referring to FIG. 1, a schematic illustrates a bottom-hole assembly (BHA) 100 or an expandable reamer assembly for drilling into a subterranean formation in accordance with embodiments of the present disclosure. In general, the schematic illustrates various components, discussed below, which may be selected for use in one or more portions (e.g., are formed in one piece) of the drill string or BHA 100. In some embodiments, such components may be integrally formed in one or more sections of the drill string or may comprise modules that are interchangeable.

As shown in FIG. 1, an expandable reamer module 110 may be coupled to or integrally formed with one of various activation modules 120, such as an electronic and hydraulic activation module 122 or a mechanical activation module 124. As used herein, the phrase "electronic and hydraulic activation module" may include a module configured to activate a closed hydraulic system (i.e., a system including hydraulic fluid separated from drilling fluid) using an electrical signal. The electrical signal may be generated at the surface of the earth, for example on a rig floor, above the subterranean formation being reamed or may be generated by the electronic and hydraulic activation module 122 in response to a non-electrical signal received from an operator at the surface. An example of an electronic and hydraulic activation module that may be used as the electronic and hydraulic activation module 122 is described in detail, for example, in the incorporated by reference U.S. Pat. No. 9,341,027. The electronic and hydraulic activation module 122 may be configured to be activated by receiving a signal from the surface of the subterranean formation using a conductive wire, a radio-frequency identification (RFID) chip carried to the electronic and hydraulic activation module 122 by drilling fluid, a predetermined sequence of pressure pulses in the drilling fluid (also referred to as "mud pulse telemetry"), a predetermined (e.g., high) level of pressure in the drilling fluid, or a predetermined (e.g., high) drilling fluid flow rate. Once such a signal is received, the electronic and hydraulic activation module 122 may electrically activate a hydraulic portion of the electronic and hydraulic activation module 122. As used herein, the phrase "mechanical activation module" may include a module configured to be activated mechanically, without the use of an electrical signal. For example, the mechanical activation module 124 may be activated by a pressure differential caused by placement of an obstruction in a drilling fluid flow path within the tool. The obstruction may be introduced into the drilling fluid flow path, such as by dropping a drop ball into the drilling fluid flow path. In other embodiments, the obstruction may be initially positioned in the mechanical activation module 124 and configured to break one or more shear pins in response to high drilling fluid pressure to cause the mechanical activation module 124 to be activated.

Regardless of the activation feature by which the selected activation module 120 is activated, each of the activation modules 120 may include an axially movable activation member (e.g., an elongated tube, rod, or piston) that is configured to be coupled to and move a sleeve of the expandable reamer module 110 during operation, to move at least one reamer blade of the expandable reamer module 110 between a deactivated (e.g., retracted) position and an activated (e.g., extended, expanded) position. The activation module 120 of the present disclosure may be configured to be positioned above the expandable reamer module 110 and to pull a sleeve within the expandable reamer module 110 toward the activation module 120 and opposite a direction of flow of drilling fluid through the BHA 100 or expandable reamer assembly during use of the BHA or expandable reamer assembly. Such a pulling motion may result in movement of at least one reamer blade of the expandable reamer module 110 into an expanded position.

Similarly, the expandable reamer module 110 may be coupled to or integrally formed with any of various stabilizer or linking modules 130, such as a linking module 132 (as shown in dashed line) without stabilizer blades or a stabilizer module 134 with stabilizer blades. A pilot bit 140 of any type (e.g., a drag bit, a diamond impregnated bit, a roller cone bit, etc.) may be coupled to or integrally formed with any of the stabilizer or linking modules 130. In other embodiments, the pilot bit 140 may be coupled directly to the expandable reamer module 110 without use of a separate stabilizer or linking module 130.

The expandable reamer module 110 may be configured to be activated (i.e., to expand one or more reamer blades thereof) indirectly by any of the activation modules 120. In particular, the expandable reamer module 110 may be configured to be activated by an activation member of the activation module 120 pulling on a sleeve disposed within the expandable reamer module 110. Accordingly, the expandable reamer module 110 itself may lack any mechanism or device configured to be directly activated, and it may not be possible to activate the expandable reamer module 110 without the activation module 120. In addition, the expandable reamer module 110 may lack a spring therein configured to bias the expandable reamer module 110 to one of the activated and deactivated positions. Rather, activation of the expandable reamer module 110 may be accomplished by one of the separate activation modules 120 operatively coupled to the expandable reamer module 110. In other words, the expandable reamer module 110 may be a slave unit that reacts to activation and/or deactivation from one of the activation modules 120, which acts as a master unit for providing a motive force to the expandable reamer module 110.

Although only the activation modules 120, the expandable reamer module 110, the stabilizer or linking modules 130, and the pilot bit 140 are shown in the BHA 100 of FIG. 1 for simplicity of explanation, the present disclosure also includes BHAs having other possible combinations of modules, which may include additional or alternative modules or components. For example, a steering module, a downhole motor module, an expandable stabilizer module, or any other module may be interchangeably coupled with one or more of the modules described in detail herein to provide options for forming various BHAs, as desired.

By way of example and not limitation, the electronic and hydraulic activation module 122 may be used when the expandable reamer module 110 is to be activated and deactivated repeatedly, when more accurate and timely control over the activation and deactivation of the expandable reamer module 110 is desired, or when a drilling fluid flow path is obstructed in a manner that a drop ball cannot reach the activation module 120, such as by a so-called "measurement-while-drilling" (MWD) tool, a downhole motor, etc., above the reamer in the BHA 100. The expandable reamer module 110 coupled to the electronic and hydraulic activation module 122 may be positioned in a borehole (e.g., the same borehole that was reamed previously with the expandable reamer module 110 while activated by the mechanical activation module 124, or a different borehole) in the subterranean formation. The electronic and hydraulic activation module 122 may be activated by receiving an electronic signal, which may cause the electronic and hydraulic activation module 122 to activate the expandable reamer module 110. One or more reamer blades of the activated expandable reamer module 110 may engage the subterranean formation and remove material from the subterranean formation.

In some embodiments, more than one reamer assembly (including an expandable reamer module 110 and an activation module 120) may be used in a BHA. For example, a first expandable reamer module 110 may be coupled to a first activation module 120 and positioned at a first location in the BHA (e.g., at a top of the BHA, at an initial location in a drilling fluid flow path passing through the BHA) and a second expandable reamer module 110 may be coupled to a second activation module 120 and positioned at a second location in the BHA (e.g., at a location in the BHA proximate the pilot bit 140, immediately adjacent to the pilot bit 140, at any location below the first location). The first and second expandable reamer modules 110 may be substantially identical to each other, while the first and second activation modules 120 may be different from each other. For example, the first and second activation modules 120 may be configured to be activated by different activation features. Thus, the first activation module 120 may be a mechanical activation module 124 configured to be activated by a drop ball and the second activation module 120 may be an electronic and hydraulic activation module 122 configured to be activated by an electrical signal, mud pulse telemetry, a predetermined level of pressure in the drilling fluid, or a predetermined drilling fluid flow rate. During use, the second activation module 120 may be activated after the first activation module 120 even if a drop ball obstructs a fluid flow path to the second activation module 120 that would preclude a drop ball from reaching the second activation module 120.

Figure 2:
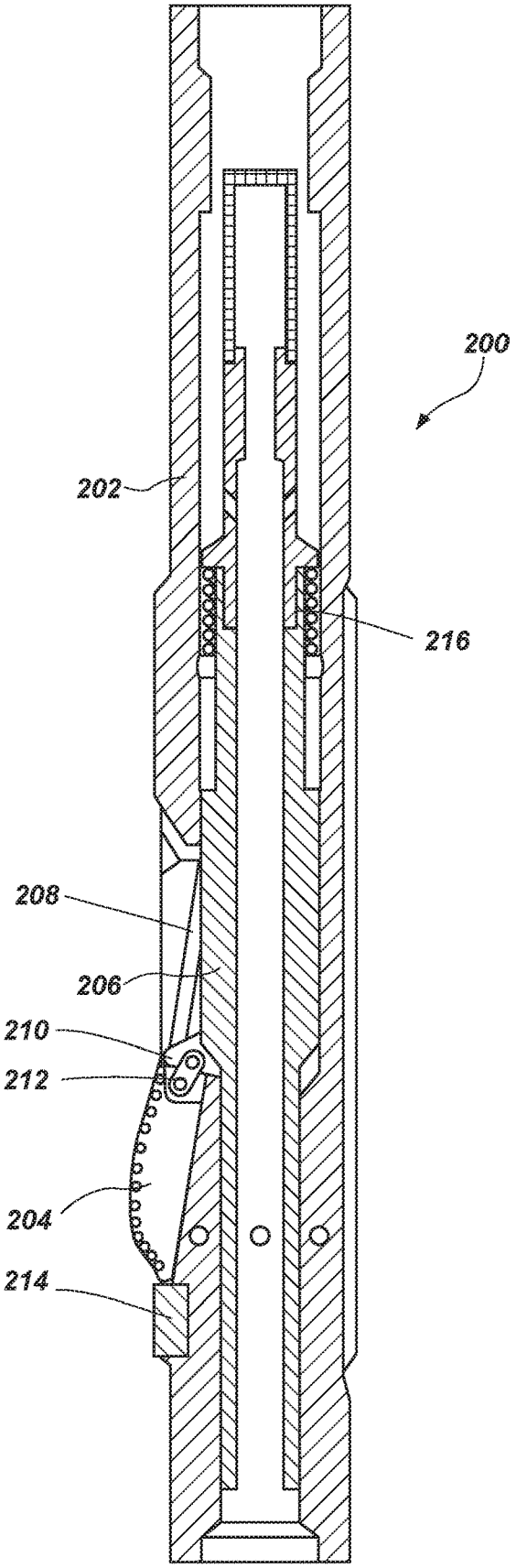
FIG. 2 shows a cross-sectional side view of an expandable reamer module in an activated position according to an embodiment of the present disclosure.

Referring to FIG. 2, an embodiment of an expandable reamer module 200 is shown, which may be used as the expandable reamer module 110 of FIG. 1. FIG. 2 illustrates the expandable reamer module 200 in an activated position, which is also referred to herein as an expanded or extended position. The expandable reamer module 200 may include a tubular body 202 having an inner bore and an outer surface, at least one reamer blade 204, and a sleeve 206 (which may, in some embodiments, be characterized as a "push sleeve" for pushing the at least one reamer blade 204 upwardly into an expanded position). A drilling fluid flow path may extend through the inner bore of the tubular body 202. The tubular body 202 may include at least one track 208 along which the at least one reamer blade 204 is movable. The at least one track 208 may extend upward and outward between the inner bore of the tubular body 202 and an outer surface of the tubular body 202 at an acute angle to a longitudinal axis of the expandable reamer module 200. The at least one reamer blade 204 may be slidably coupled to the at least one track 208 to enable the at least one reamer blade 204 to slide from a deactivated position to an activated position. The sleeve 206 may be disposed at least partially within the tubular body 202 and may be movable along the longitudinal axis between the deactivated position and the activated position. The sleeve 206 may be coupled to the at least one reamer blade 204 such that axial movement of the sleeve 206 results in movement of the at least one reamer blade 204 along the at least one track 208. Although the sleeve 206 is illustrated in FIG. 2 as being fully disposed within the tubular body 202, in other embodiments, the sleeve 206 may have a length sufficient to extend beyond a longitudinal end of the tubular body 202 in one or both of the deactivated position and the activated position.

A yoke 210 may be rigidly coupled to the sleeve 206, such as by one or more of threads, mechanical interference, and a weld, for example. The yoke 210 may be configured to force (e.g., push against) the at least one reamer blade 204 to slide the at least one reamer blade 204 along the at least one track 208 from the deactivated position toward the activated position. A rotatable link 212 may be used to couple the yoke 210 to the at least one reamer blade 204 to enable the yoke 210 to force (e.g., pull) and slide the at least one reamer blade 204 along the at least one track 208 from the activated position toward the deactivated position. In the activated position, the at least one expandable reamer blade 204 may rest against a stop block 214 positioned on the tubular body 202 proximate an end of the at least one track 208.

The expandable reamer module 200 may include any number of expandable reamer blades 204, such as one, two, three, four, or more than four. The yoke 210 may include a number of protrusions corresponding to the number of expandable reamer blades 204. Similarly, the tubular body 202 may include a number of tracks 208 corresponding to the number of expandable reamer blades 204. A number of stop blocks 214 corresponding to the number of expandable reamer blades 204 may be coupled to the tubular body 202.

As can be seen in FIG. 2, a joint structure 216 may be coupled to a longitudinal end of the sleeve 206. The joint structure 216 may be configured to join the sleeve 206 to an activation member (e.g., an elongated tube, rod, or piston) of a separate activation module to transmit motive force to the sleeve 206, to axially move the sleeve 206 between the deactivated position and the activated position.

Referring back to FIG. 1, the BHA 100 or reamer assembly may further include a communications assembly 150 that acts to alter one or more operational conditions downhole to provide one or more communications regarding the BHA 100 or drilling operation to a receiving device 160 at a separate or remote location. For example, the communications assembly 150 may act to provide feedback to an operator of the BHA 100 located, for example, at the surface opening of the borehole, via the receiving device 160. As depicted, the communications assembly 150 may be a separate sub coupled in the BHA 100. In other embodiments, the communications assembly 150 may be disposed within one portion of the BHA 100 (e.g., the expandable reamer module 110).

The communications assembly 150 may include a component for altering an operational characteristic (e.g., a physical operational characteristic) of the BHA 100. For example, the communications assembly 150 may include a mechanical actuator (e.g., flow restrictor 152) for the altering the rate of fluid flow through a section of the BHA 100 (e.g., altering the flow of drilling fluid or mud through the drill string). Alteration of the flow rate will act to produce changes in the pressure of the fluid traveling through the BHA 100. In some embodiments, the flow restrictor 152 may include a flow channel and one or more components for obstructing the flow channel (e.g., by reducing the cross-sectional area of the flow channel through the flow restrictor 152) in order to reduce the amount (e.g., the volume of flow) traveling through the communications assembly 150. In other embodiments, the communications assembly 150 may act on flow through the BHA 100 in other manners, such as, for example, utilizing differing flow paths (e.g., bypass valves, nozzles) to increase and/or decrease the overall amount of flow through a given area of a drilling fluid path through the BHA, thereby altering the pressure in the BHA 100. In some embodiments, the flow through the BHA 100 may be altered by systems including electrically-actuated and/or hydraulically-actuated components.

The BHA 100 (e.g., the communications assembly 150) may further include one or more electronic devices for working in cooperation with the communications assembly 150. For example, associated electronic devices, such as, a processing unit 154, a power and communication unit 156, and one or more sensors 158 may be positioned within the BHA 100. The processing unit 154 may comprise a microcontroller-based embedded system running executable code in accordance with an algorithm to compile and compress information received in signals from the one or more sensors 158.

As depicted, one or more of the processing unit 154, power and communication unit 156, and sensor or sensors 158 may be located external to the communications assembly 150 (e.g., on or within the expandable reamer module 110). In other embodiments, one or more of the processing unit 154, power and communication unit 156, and sensor or sensors 158 may be located at or within the communications assembly 150. However, as discussed below in more detail, the placement of the sensor or sensors 158 may be dictated by the component or components of the BHA 100 that the sensor or sensors 158 may be intended to monitor.

A sensor 158 may be located on the BHA 100 to sense (e.g., monitor, determine) at least one operational parameter of the BHA 100. For example, the sensor 158 may be positioned on an actuation member of the expandable reamer module 110 (e.g., the sleeve 206 and/or the yoke 210 (FIG. 2)). Such positioning may enable the sensor 158 (e.g., a sensor for measuring at least one type of movement) to determine the position of the reamer blades 204 (FIG. 2). For example, the sensor 158 may be utilized to determine (e.g., based on known positions of the reamer blades 204 relative to the sleeve 206 or yoke 210) the extent the reamer blades 204 have been deployed from the expandable reamer module 110 (e.g., fully retracted, partially deployed, fully deployed or extended). In some embodiments, a sensor 158 may comprise a sensor for determining linear movement of a component of the BHA, such as, for example, a linear voltage differential transformer (LVDT) sensor, or another type of differential sensor. In other embodiments, a sensor 158 may comprise a sensor for determining an extent or speed of rotational movement of a component of the BHA 100, such as, for example, a rotary encoder. In other embodiments, a sensor 158 may comprise one or more of contact or proximity switch sensors (e.g., inductive, capacitive, magnetic, and/or photoelectric sensors), optical sensors, sensors for determining a position of a component of a motor, fluid flow sensors, wear sensors, and force sensors (e.g., strain gauges). In yet other embodiments, a sensor 158 may comprise one or more pressure sensors for determining the increase or decrease of a pressure inside or outside the BHA 100 (e.g., the pressure increase or decrease in a downhole packer module or downhole isolation packer module).

While the sensor 158 is discussed above in particular for use in determining the position of the reamer blades 204 (FIG. 2), a sensor or sensors 158 may be implemented in numerous other applications to determine a status (e.g., one or more operational characteristics) of one or more components of a BHA 100 (e.g., the expandable reamer module 110 or another downhole component). For example, a sensor 158 may be used to determine one or more of wear on a component of the BHA 100, temperature (e.g., annulus, borehole, and/or differential pressure), pressure (e.g., annulus, borehole, and/or differential pressure), drilling dynamics, such as, vibration, stick-slip phenomenon, whirl, bit bounce, bending forces (e.g., moments), torque, differential torque, weight, differential weight, etc. In some embodiments, operational characteristics may include the status or condition of a downhole component. In some embodiments, such operational characteristics may include information regarding the formation or borehole (e.g., a formation parameter or borehole parameter), such as, formation evaluation measurement (e.g., acoustic, resistivity, nuclear, nuclear magnetic resonance (NMR)), which may identify a specific condition in the formation that is beneficial to be communicated to the surface. In some embodiments, a borehole condition may be communicated to the surface, like a "kick," for example, hydrogen sulfide ($H_2S$) gas entering the borehole, an instable borehole that leads to decreased borehole diameter, accumulation of cuttings in cutting beds in horizontal boreholes which may lead to a stuck pipe event, and changing mud properties, like mud weight, temperature, temperature differences, pressure, and/or pressure differences.

The processing unit 154 may act to process and/or relay data from the sensor 158. In some instances, the processing unit 154 may be programmed to delay data transmission to the communications assembly 150 during unstable flow conditions through the BHA 100, to enhance reliability. In other instances, the processing unit 154 may be programmed to cause communications assembly 150 to transmit patterns (e.g., redundant patterns, unique patterns, etc.) of pressure pulses indicative of the same condition of the BHA component for increased confidence of the recipient. The power and communication unit 156 may act to power one or more of the sensor or sensors 158, the processing unit 154, and the communications assembly 150 (e.g., the flow restrictor 152). In some embodiments, power may be provided individually to the communications assembly 150 and related components via a power generation unit (e.g., turbine) in the BHA 100 such that the communications assembly 150 and related components comprise a standalone device that is not required to be connected to power and/or communications from other components in the BHA 100.

Figure 3:
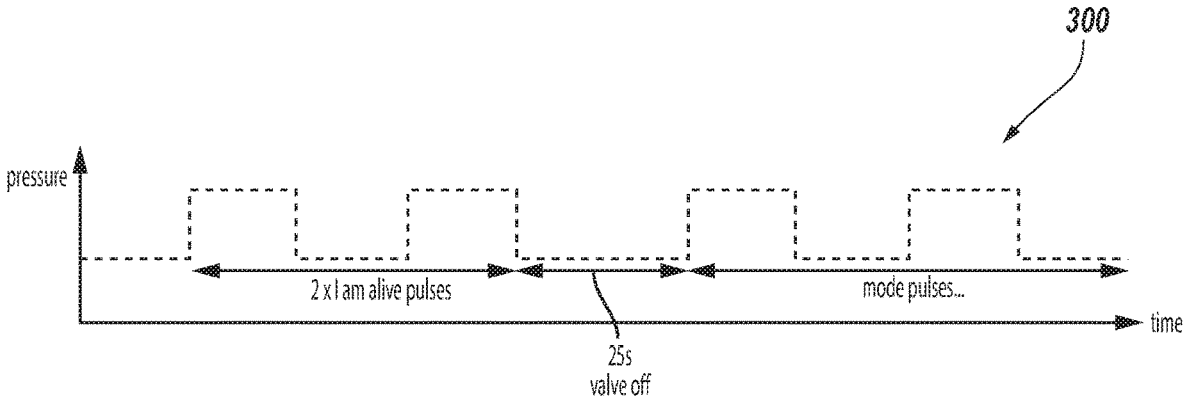
FIG. 3 shows a graph illustrating an exemplary series of pulses that may be used for communicating a status of a downhole assembly.

FIG. 3 shows a graph illustrating an example of a series of pulses 300 that may be used for communicating a status (e.g., one or more operational characteristic) of a downhole assembly. As depicted, the pattern of the series of pulses 300 may indicate increases (e.g., spikes) in pressure over time, as well as relative magnitudes of pressure spikes, and time intervals between spikes. Referring to FIGS. 1 and 3, the series of pulses 300 may correlate to the restricting of the fluid flow by the communications assembly 150 with the flow restrictor 152. For example, the restriction of the flow through the BHA 100 by the flow restrictor 152 may act to increase the pressure in the drill string. Likewise, the removal of the restriction of the flow through the BHA 100 by the flow restrictor 152 may act to decrease the pressure in the drill string. This timed increase and decrease in pressure, as well as magnitude of such increases and decreases, may be detected and logged at the receiving device 160 (e.g., by a pressure gauge at the surface opening of the borehole) as the series of pulses 300.

As discussed above, the restricting of the flow rate with the flow restrictor 152 may be controlled by the processing unit 154. The processing unit 154 may restrict the flow in response to one or more signals corresponding to readings from the sensor 158, which is in communication with the processing unit 154 (e.g., via a wired or wireless connection). The number of, duration of, and spacing between the pulses may be controlled by the processing unit 154 (e.g., via the flow restrictor 152) in order to provide a message to the receiving device 160. The number and duration of pulses and duration between the pulses may be selected from a database of preselected pulse patterns that may be accessed by the processing unit 154. For example, the database may be stored on memory in the processing unit 154. In some embodiments, the number and duration of pulses and duration between the pulses may correlate to: an indication that the reamer blades 204 (FIG. 2) are fully extended, the reamer blades 204 are partially extended, the reamer blades 204 are fully retracted, there is an error in retracting and/or extending the reamer blades 204, the state of fluid flow through the expandable reamer module 110 (e.g., one or more valves within the expandable reamer module 110 are opened or closed), or other operational characteristics.

In some embodiments, the amplitude of the pulses may be altered to provide additional patterns.

In some embodiments, beginning transmitting of a signal, continuing the signal transmission, signal modulation, signal conversion, amplitude modulation, frequency modulation, phase modulation, pulse width modulation may be utilized to selectively provide communication from the communications assembly 150. For example, the BHA 100 (e.g., the communications assembly 150, the processing unit 154) may include a modulator 162 for modulating a transmitted signal. Such a modulator 162 may act to alter a transmitted signal through amplitude modulation, phase modulation, frequency modulation, and/or pulse width modulation.

Figure 4:
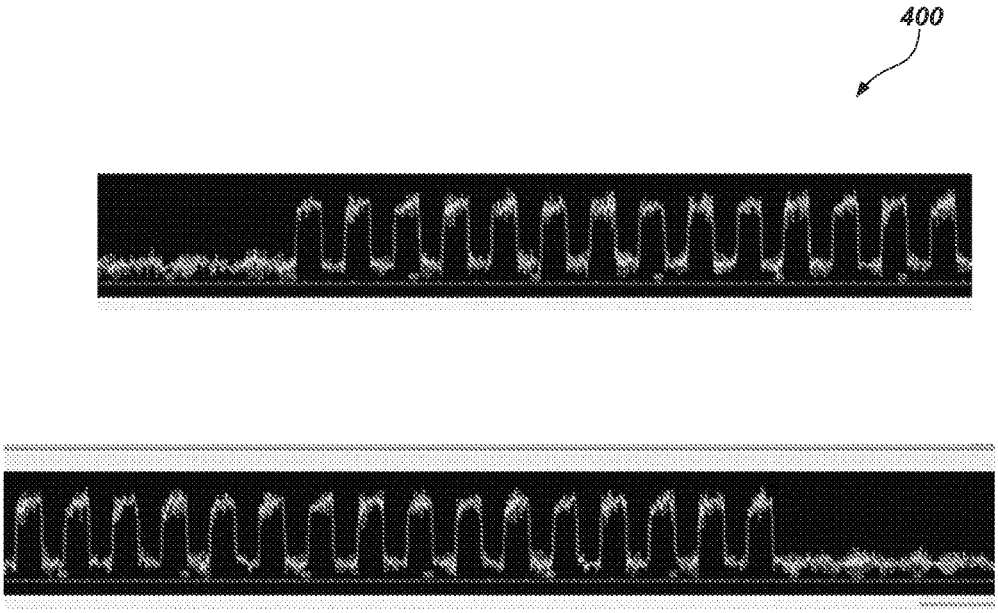
FIG. 4 shows another graph illustrating an exemplary series of pulses that may be used for communicating a status of a downhole assembly.

In further embodiments, and as shown in FIG. 4, a series of pulses 400 (e.g., where the duration of the pulses and the duration between pulses is substantially constant) may indicate a certain condition in a downhole component (e.g., movement of an element, an operational state or condition, etc.). For example, the number, duration and phase of pulses, and duration between the pulses may indicate that the reamer blades 204 are being moved between the extended and retracted state. As depicted in FIG. 4, a steady pulse (e.g., where the duration of the pulses and the duration between pulses is substantially constant) may indicate the reamer blades 204 are in the process of between retracted or expanded. When the reamer blades 204 have ceased moving (e.g., after reaching an intended position), the pulses may cease as an indication to the receiving device 160 that the reamer blades 204 have be placed in an expected position. In some embodiments, the pulses may continue (e.g., in a differing pattern) if the reamer blades 204 have ceased moving and are not in an expected position.

In yet further embodiments, the number, duration and phase of pulses and duration between the pulses may indicate the operational state of the expandable reamer module 110. For example, the number and duration of pulses and duration between the pulses may indicate that the expandable reamer module 110 and/or one or more components of the communications assembly 150 are ready, are operating, and/or are in an error state.

As should be appreciated, the pulsing may be patterned in any number of various manners to indicate numerous operational characteristics of a downhole assembly as long as the patterns can be implemented by the processing unit 154 (e.g., via the flow restrictor 152) and received at the receiving device 160 (e.g., and decoded by the receiving device 160, another device, and/or the operator). The generation of the pattern may utilize amplitude modulation, phase modulation, frequency modulation, pulse width modulation, pulse position modulation. The pattern may carry various kinds of information. The pattern may comprise a portion that carries information about the type of component to which it is related. In other embodiments, the pattern may comprise information on at least one data point sensed by the sensor. In yet another embodiment, the pattern may comprise an initiation or start-up portion and/or a synchronization portion. The start-up portion may indicate what type of information will be communicated in the following another portion of the pattern and how the another portion of the pattern has to be interpreted.

In some embodiments, the receiving device may comprise a signal converter that converts the received signal in acoustic or optical signals that acoustically or optically indicates that a specific downhole condition is met. The acoustic or optical signal may be active as long as the specific downhole condition is met. The acoustic or optical signal may act as a warning signal, depending on the severity of the specific downhole condition.

Embodiments of the disclosure may be particularly useful in providing communications assemblies and systems that can indicate and communicate numerous operational characteristics of a downhole assembly without having to implement a fully integrated electrical system for controlling components of the BHA and for communicating with an operator at the surface opening of the borehole. Such communications assemblies and associated assemblies may be standalone devices that operate under their own power and are not required to be in communication with other portions of the BHA. Such configurations may enable the use of BHA components from a number of different suppliers without having to address communications compatibility issues between the components.

In some embodiments, the communication may be relatively simple and clear (e.g., may not be required to be substantially decoded) and may not require a specifically trained operator in order to interpret the communicated information. Further, the series of pulses may act to communicate a specific downhole condition that can be communicated in a relatively simple manner by slowly altering a fluid flow pattern such that the pattern can be received and understood without the need of any decoding system.

In some embodiments, automated monitoring and interpretation of the communicated information may be relatively simply and easily implemented. Therefore, the embodiments of the disclosure are an option for simple drilling rigs, like batch drilling rigs or land rigs in general, with no possibility to decode complex signals.

The embodiments of the disclosure described above and illustrated in the accompanying drawing figures do not limit the scope of the disclosure, since these embodiments are merely examples of embodiments of the disclosure. The disclosure is defined by the appended claims and their legal equivalents. Any equivalent embodiments lie within the scope of this disclosure. Indeed, various modifications of the present disclosure, in addition to those shown and described herein, such as alternative useful combinations of the elements described, will become apparent to those of ordinary skill in the art from the description. Such modifications and embodiments also fall within the scope of the appended claims and their legal equivalents.

What is claimed is:

1. A downhole assembly, comprising:
- at least one sensor configured to sense at least one parameter relating to a downhole condition; and
- a communications assembly comprising:
  - at least one device for controlling a characteristic of fluid flow through the downhole assembly; and
  - a processor in communication with the at least one sensor, the processor configured to generate at least one signal that can be interpreted by an operator without assistance of a decoding system by selectively and slowly altering the characteristic of fluid flow through the downhole assembly with the at least one device in response to data received from the at least one sensor.

2. The downhole assembly of claim 1, wherein the communications assembly is configured to continue the at least one signal as long as the at least one parameter relating to a downhole condition is within a preselected range.

3. The downhole assembly of claim 1, wherein the at least one device for controlling the characteristic of fluid flow through the downhole assembly is configured to generate at least one of a pressure variation in the fluid flow, a flow variation in the fluid flow, a pressure level in the fluid flow, or a rate of the fluid flow through the downhole assembly.

4. The downhole assembly of claim 1, wherein the at least one sensor is configured to sense at least one operational characteristic of a downhole tool.

5. The downhole assembly of claim 1, wherein the at least one sensor is configured to sense at least one movement of at least one component of a downhole tool.

6. The downhole assembly of claim 5, wherein the downhole tool comprises an expandable tool.

7. The downhole assembly of claim 6, wherein the at least one sensor is configured to sense at least one movement of at least one blade of the expandable tool.

8. The downhole assembly of claim 1, wherein the at least one sensor is configured to sense at least one of a condition of a borehole, a condition of a subterranean formation, or a condition of a downhole tool.

9. The downhole assembly of claim 1, further comprising a modulator in the downhole assembly configured to modulate the at least one signal by a preselected pattern.

10. The downhole assembly of claim 9, wherein the modulator is configured to modulate the at least one signal with the preselected pattern comprising at least one of an amplitude modulation, a phase modulation, a frequency modulation, a pulse width modulation, or a pulse position modulation.

11. A method for monitoring a downhole condition comprising:
- positioning a downhole tool into a borehole in a subterranean formation;
- sensing a parameter relating to a downhole condition with a sensor of the downhole tool;
- determining if a preselected downhole condition is met in response to the sensed parameter with a processor;
- transmitting a signal having a pattern that is slow enough to be interpreted by an operator without assistance of a decoding system in response to the determination that the preselected downhole condition is met; and
- continuing the signal as long as the preselected downhole condition is met.

12. The method of claim 11, wherein the transmitting the signal comprises generating at least one of a pressure variation in fluid flow, a flow variation in the fluid flow, a pressure level in the fluid flow, or a rate of the fluid flow through a downhole assembly.

13. The method of claim 11, further comprising receiving the signal with a receiving device at a surface opening of the borehole.

14. The method of claim 13, further comprising converting the received signal with a signal converter of the receiving device into an acoustic signal or an optical signal.

15. The method of claim 11, wherein sensing a parameter relating to the downhole condition comprises at least one of:
- sensing a movement of at least one component of a downhole tool;
- sensing a condition of the borehole;
- sensing a condition of the subterranean formation; or
- sensing a condition of the downhole tool.

16. The method of claim 11, further comprising modulating the transmitted signal by a preselected pattern.

17. An expandable tool assembly for reaming a subterranean borehole, the expandable tool assembly comprising:
- an expandable tool module comprising:
  - at least one blade configured to move between a retracted position and an extended position; and
  - at least one sensor configured to sense movement of the at least one blade between the retracted position and the extended position; and
- a communications assembly comprising:
  - at least one device for controlling a characteristic of fluid flow through the expandable tool assembly; and
  - a processor in communication with the at least one sensor, the processor configured to selectively and slowly alter the characteristic of fluid flow through the expandable tool assembly with the at least one device in response to data received from the at least one sensor to generate at least one signal that can be interpreted by an operator without assistance of a decoding system.

18. The expandable tool assembly of claim 17, wherein the at least one device comprises at least one of a flow restrictor and a flow diverter.

19. The expandable tool assembly of claim 17, wherein the processor is further configured to selectively alter the characteristic of fluid flow through the expandable tool assembly with the at least one device in order to alter a pressure in a fluid in a drill string in which the expandable tool assembly is positioned.

20. The expandable tool assembly of claim 19, further comprising a receiving device for monitoring the pressure in the fluid from a location remote from the communications assembly to determine a pattern communicated from the processor via the pressure in the fluid.

21. The downhole assembly of claim 1, wherein the processor is configured to slowly alter the characteristic of fluid flow through the downhole assembly with the at least one device by altering between a first pressure and at least a second pressure and maintaining pressure for at least a plurality of seconds each time the pressure is altered between the first pressure and the at least a second pressure.

22. The downhole assembly of claim 21, wherein the processor is further configured to alter between the first pressure and the at least a second pressure for at least one minute to generate one signal of the at least one signal that can be interpreted by an operator without the assistance of a decoding system.

23. The method of claim 11, wherein transmitting a signal having a pattern that is slow enough to be interpreted by an operator without the assistance of a decoding system comprises transmitting a signal having a pattern of pressure spikes each having a duration of a plurality of seconds and intervals between pressure spikes each having a duration of a plurality of seconds.

24. The method of claim 23, further comprising transmitting the signal over at least one minute.

25. The expandable tool assembly of claim 17, wherein the processor is configured to slowly alter the characteristic of fluid flow through the expandable tool assembly with the at least one device by altering between a first pressure and at least a second pressure and maintaining pressure for at least a plurality of seconds each time the pressure is altered between the first pressure and the at least a second pressure.

26. The expandable tool assembly of claim 25, wherein the processor is further configured to alter between the first pressure and the at least a second pressure for at least one minute to generate one signal of the at least one signal that can be interpreted by an operator without the assistance of a decoding system.

* * * * *